US005941376A

United States Patent [19]

Liggett

[11] Patent Number: 5,941,376

[45] Date of Patent: Aug. 24, 1999

[54] SOAP BAR CONTAINER

[76] Inventor: James R. Liggett, R.R. 2 Box 911, Cornish, N.H. 03745

[21] Appl. No.: 09/056,322

[22] Filed: Apr. 7, 1998

[51] Int. Cl.[6] ..... A47K 5/02

[52] U.S. Cl. ..... 206/77.1; 206/550; 4/628; 34/202

[58] Field of Search ..... 206/77.1, 541, 206/550, 581, 823; 34/202, 201; 4/628

[56] References Cited

U.S. PATENT DOCUMENTS

| | | | |
|---|---|---|---|
| 3,377,121 | 4/1968 | Billesbach et al. | 206/77.1 |
| 3,899,073 | 8/1975 | Bar | 206/77.1 |
| 4,035,122 | 7/1977 | Cavanaugh | 206/77.1 |
| 4,344,529 | 8/1982 | Ibarzabal | 206/77.1 |
| 4,858,757 | 8/1989 | Liggett | 206/77.1 |
| 4,861,505 | 8/1989 | Farman | 206/77.1 |
| 4,938,346 | 7/1990 | Urbano | 206/77.1 |
| 5,033,613 | 7/1991 | Liggett | 206/77.1 |
| 5,279,412 | 1/1994 | Lee | 206/77.1 |
| 5,509,529 | 4/1996 | Kelley | 206/77.1 |

FOREIGN PATENT DOCUMENTS

| | | | |
|---|---|---|---|
| 2446104 | 9/1980 | France | 206/77.1 |
| 293064 | 7/1965 | Netherlands | 206/77.1 |

*Primary Examiner*—Paul T. Sewell
*Assistant Examiner*—Luan K. Bui
*Attorney, Agent, or Firm*—Wolf, Greenfield & Sacks, P.C.

[57] ABSTRACT

A container for a soap bar is provided which container is formed of first and second mating sections which are hollowed to form a soap-bar-receiving chamber when the sections are mated. The chamber recess in the first section is formed so as to control the position of the soap bar therein to control the contact area of a wet soap bar with the walls of the chamber in the first section so as to minimize sticking of the soap bar to the chamber walls and to facilitate air flow through the chamber. An opening is provided in the first section to permit the soap bar to be pushed out therefrom with a users fingers and to, in conjunction with an opening in the upper section, further facilitate air flow through the container for soap bar drying. A lip or other suitable element may be provided to prevent water drippage from the openings or the openings may be otherwise designed to inhibit water from flowing therethrough.

9 Claims, 4 Drawing Sheets

SOAP BAR CONTAINER

FIELD OF THE INVENTION

This invention relates to a container for a soap bar and more particularly to a container in which a soap bar product may be packaged for traveling.

BACKGROUND OF THE INVENTION

When camping, or otherwise traveling to places where soap is not normally provided, or where a person has a particular soap which they are either required the use for health reasons or have a personal preference for, there is a need to pack a soap bar for traveling, frequently after the bar has been recently used. Packing a wet soap bar presents potential problems. First, when the bar dries, it will stick to surfaces with which it is in contact. Therefore, any container for a wet soap bar should be designed to minimize such sticking and to permit the bar to be easily dislodged when it is desired to reuse the bar. Second, it is highly preferable that there be air circulation around the bar while it is drying, and it is difficult for the bar to dry properly without such air circulation. However, it is also desirable that any water remaining on the bar when it is put in the container not leak into the luggage, backpack or the like in which the container is packed. These two requirements are in conflict, requiring a container which is not sealed so as to be airtight, while still be designed so as to substantially prevent moisture drippage from the container. Heretofore, a container which meets all of the above requirements has not existed.

SUMMARY OF THE INVENTION

In accordance with the above, this invention provides a container for a soap bar which container is formed of first and second mating sections. The first section has a first hollow recess formed therein, and the second section has a second hollow recess formed therein, the first and second recesses being sized to form a soap-bar-receiving chamber when the sections are mated. Each of the recesses is open on the side thereof adjacent the other recess when the sections are mated and has a substantially closed side opposite the open side. A plate is positioned in the first recess adjacent the opposite or closed side thereof and an opening large enough for at least one finger of an adult person to fit therein is formed in the closed side of the first recess. A support is provided on the inside of the closed side of the first recess around the opening on which the plate rests to maintain the plate spaced from the closed side, and the opening therein, sufficiently to permit air flow to and from the opening around the plate. An opening is also provided in the second recess at a position at least near the closed side thereof. The walls of the first recess are also formed so as to provide only limited contact between a soap bar in said first recess and the walls, to facilitate air flow through the first chamber around the soap bar and to control the position of the soap bar in the recess.

For preferred embodiments, a plurality of ribs are formed in the walls of the first chamber to limit contact of the soap bar with the recess walls and to facilitate air flow. The spacing between the ribs formed on opposite walls of the first recess are preferably sufficient so that a soap bar in the first recess can contact the ribs of no more than two such walls at a time.

For some embodiments of the invention, the opening in the second recess is in the opposite or closed side thereof and for preferred embodiments of the invention, the support for the plate is a plurality of bumps extending from the closed side of the first recess. A strap may also be provided which is anchored in one of the sections and extends through the other of the sections to hold the sections together when they are not mated.

In addition, suitable means may be provided for inhibiting water exiting the container through at least one of the openings at or near the opposite ends of the first and second sections, and such means are preferably provided for both openings. For a preferred embodiment, this means includes a lip having a height which is less than that of the plate support and which extends around the opening in the first recess to inhibit water exiting the container through this opening. A lip may also be provided extending around the opening in the second recess to inhibit water exiting the container from this opening.

The foregoing and other objects, features and advantages of the invention will be apparent from the following more particular description of a preferred embodiment as illustrated in the accompanying drawings.

IN THE DRAWINGS

DETAILED DESCRIPTION

Figure 3:
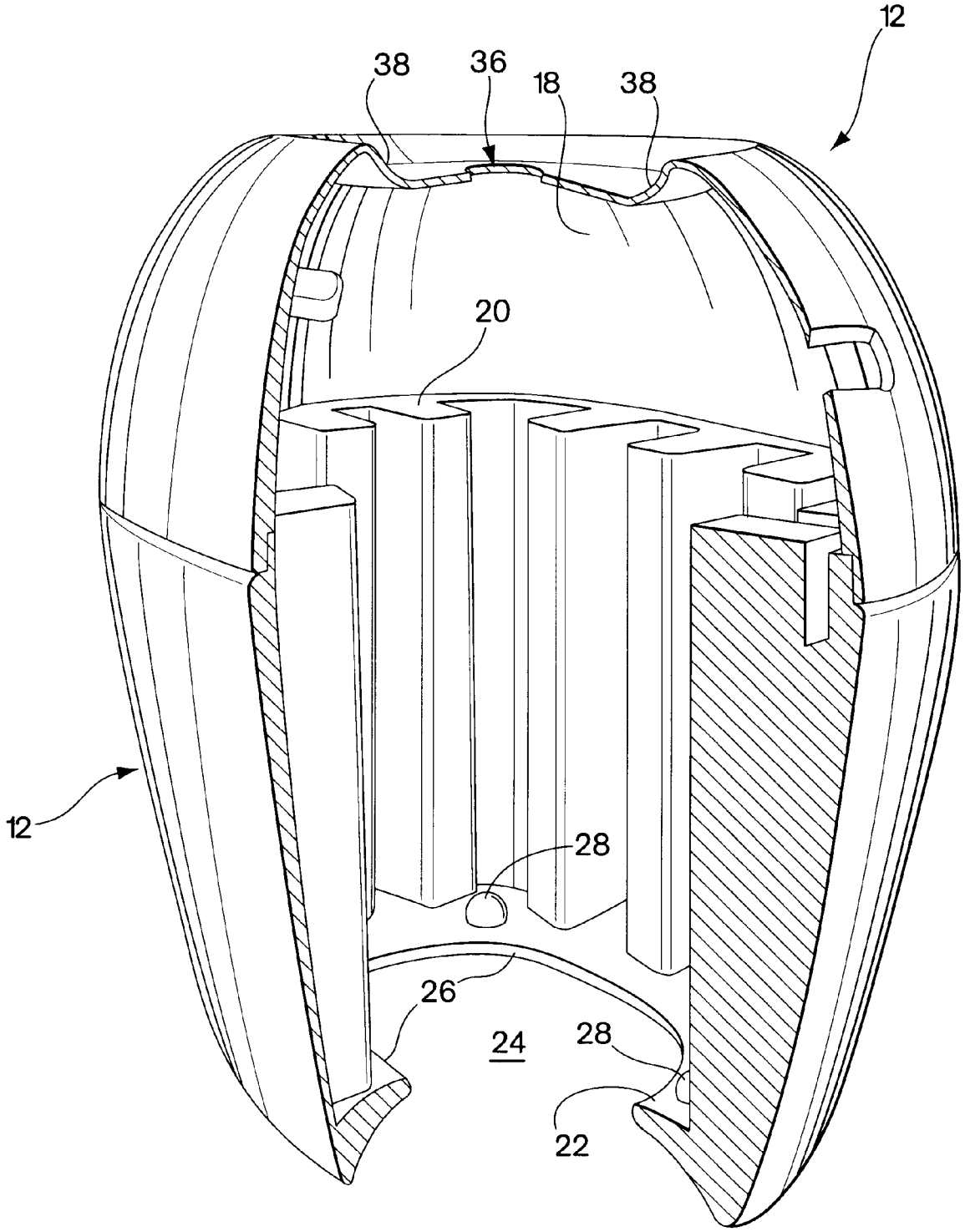
FIG. 3 is a partially broken away top front perspective view of the container shown in the previous Figures without a soap bar and with the strap omitted.

Referring to the Figures, container 10 has a lower section 12 and an upper section 14. Lower section 12 has a cavity 16 formed therein, and upper section 14 has a cavity 18 formed therein. A plurality of ribs 20 are formed in the walls of cavity 16, which ribs extend, as may be best seen in FIG. 3, for substantially the entire length of the cavity. For the embodiment shown in the Figures, there are three ribs on each side of the cavity which are substantially equally spaced from each other and are dimensioned so that the ribs constitute substantially half of the surface area of the cavity walls. However, the number, width and spacing of the ribs are not limitations on the invention.

At the bottom of cavity 16 is a base 22 having an opening 24 formed therein, which opening is at least large enough for one finger of an adult to fit easily therein and is preferably, as shown, large enough for two adult fingers to fit therein. A lip 26 extends from base 22 around opening 24 and a plurality of bumps 28 are formed in base 22 outside of lip 26. Bumps 28 are preferably evenly spaced around the periphery and have a height greater than that of lip 26, for example twice the height of the lip. For the preferred embodiments shown in the Figures, there are four bumps 28. As may be best seen in FIG. 4, a plate or wafer 30 fits in cavity 16 and is supported on bumps 28 so as to be spaced from opening 24 and has substantially the same dimensions as the spacing between ribs on opposite sides of cavity 16, but is preferably slightly smaller in each dimension than this spacing so as to avoid friction when, as will be discussed later, it is moved up and down in the cavity. Finally, bottom section 12 has a lip or projection 32 (FIG. 1) extending around the inner portion of its upper wall, the function of which will be described later.

Upper section 14 has a lip 34 formed around the outer edge of its bottom wall which lip fits over lip 32 of bottom section 12 and is sized so as to form a substantially water-tight pressure fit with lip 32 when sections 12 and 14 are pressed together. Upper section 14 also has an opening 36 formed at the top of cavity 18 and a lip 38 surrounding opening 36. A strap 40 is provided which is anchored at one end to the right side of bottom section 12, passes through a strap opening 42 on the right side of top section 14, around the outside of the top section and back through a strap opening 42 on the left side of the upper section, to be anchored on the left side of bottom section 12. Strap 40 holds the two sections together when the container is opened as shown in FIG. 1 and may also be used as a carrying handle for the container or to hang the container in a shower or other appropriate location.

Figure 1:
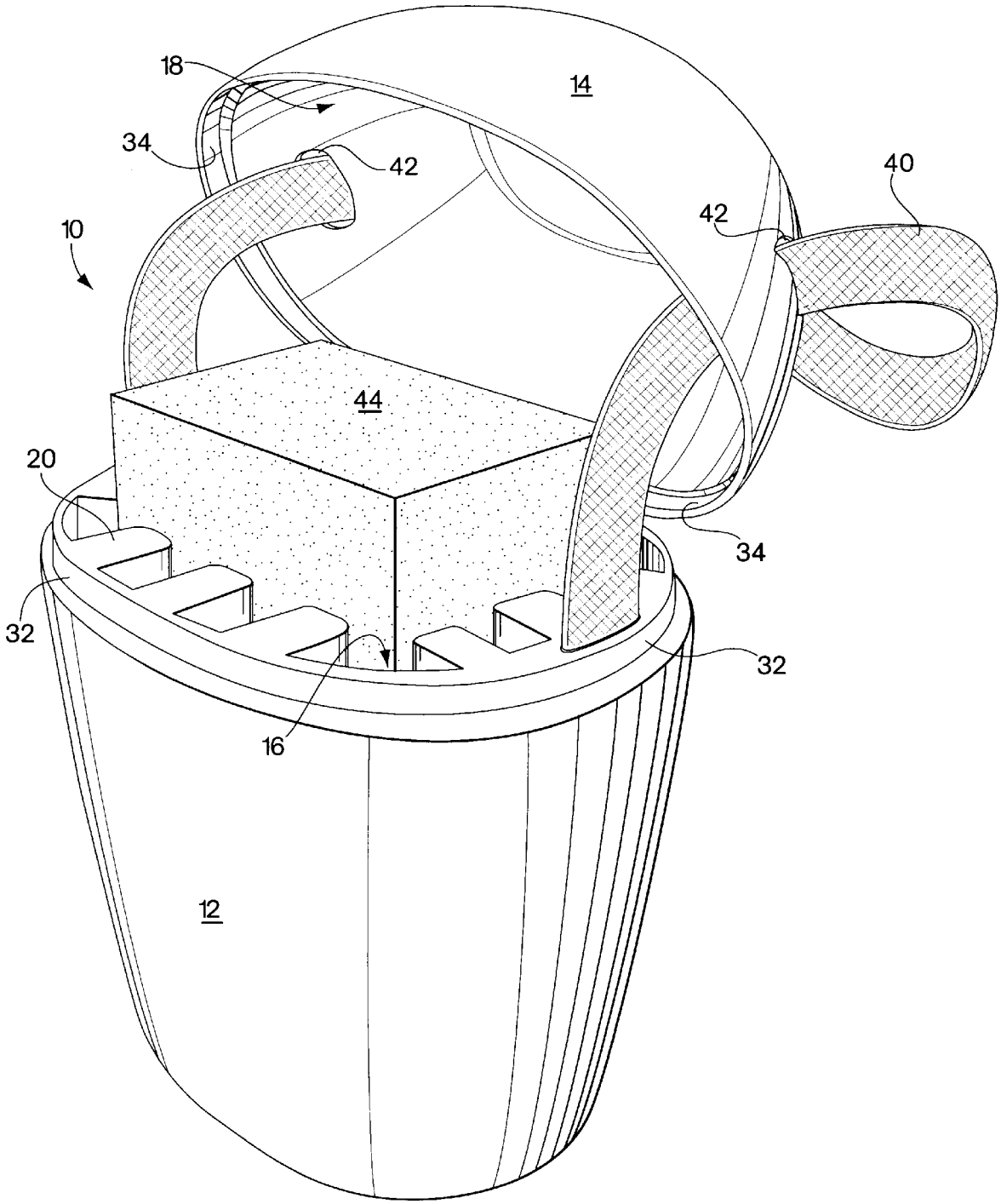
FIG. 1 is a top front perspective view of a container in accordance with the teachings of this invention in its open condition with a soap bar therein.
Figure 2:
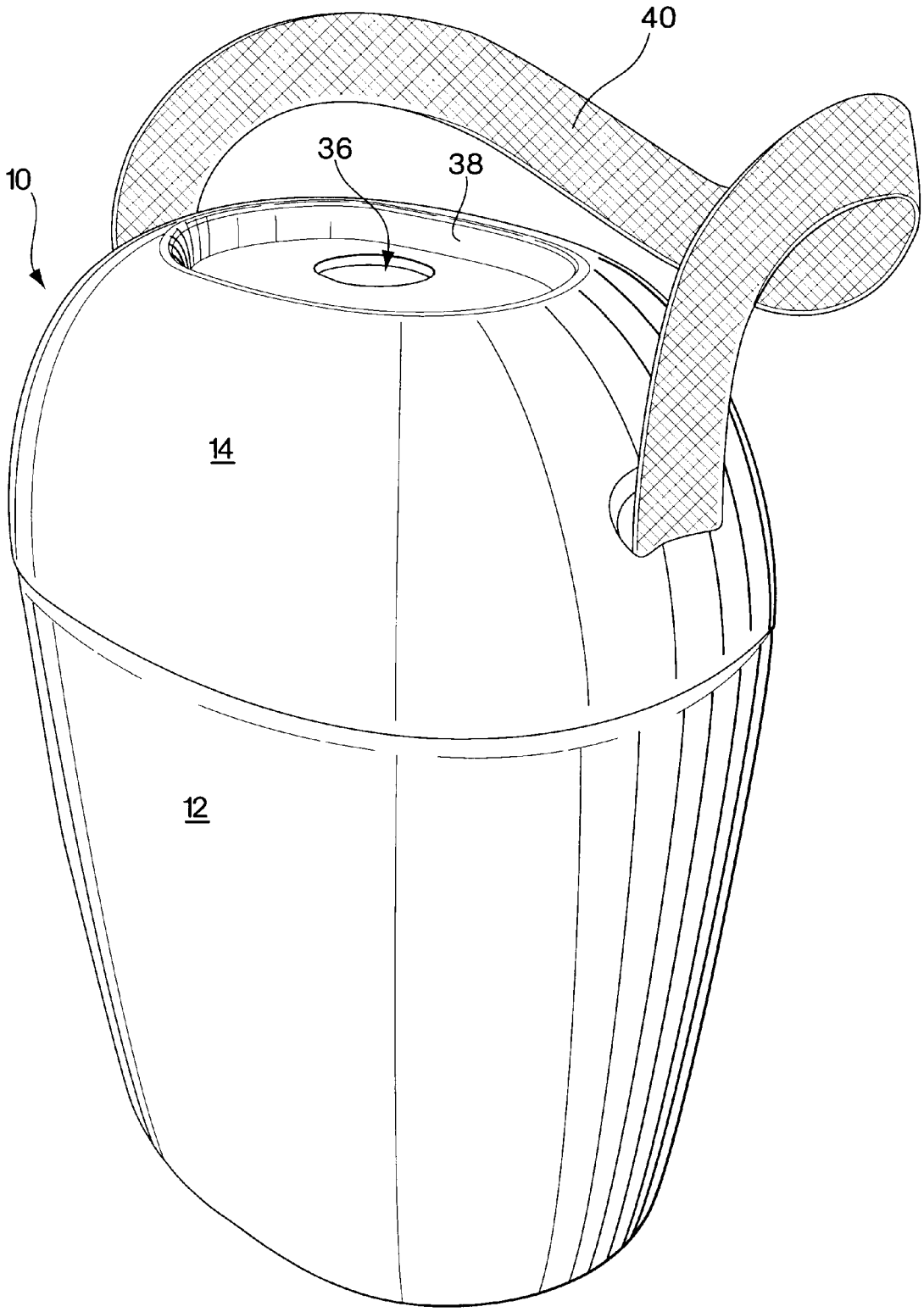
FIG. 2 is a top front perspective view of the container shown in FIG. 1 in its closed condition.
Figure 4:
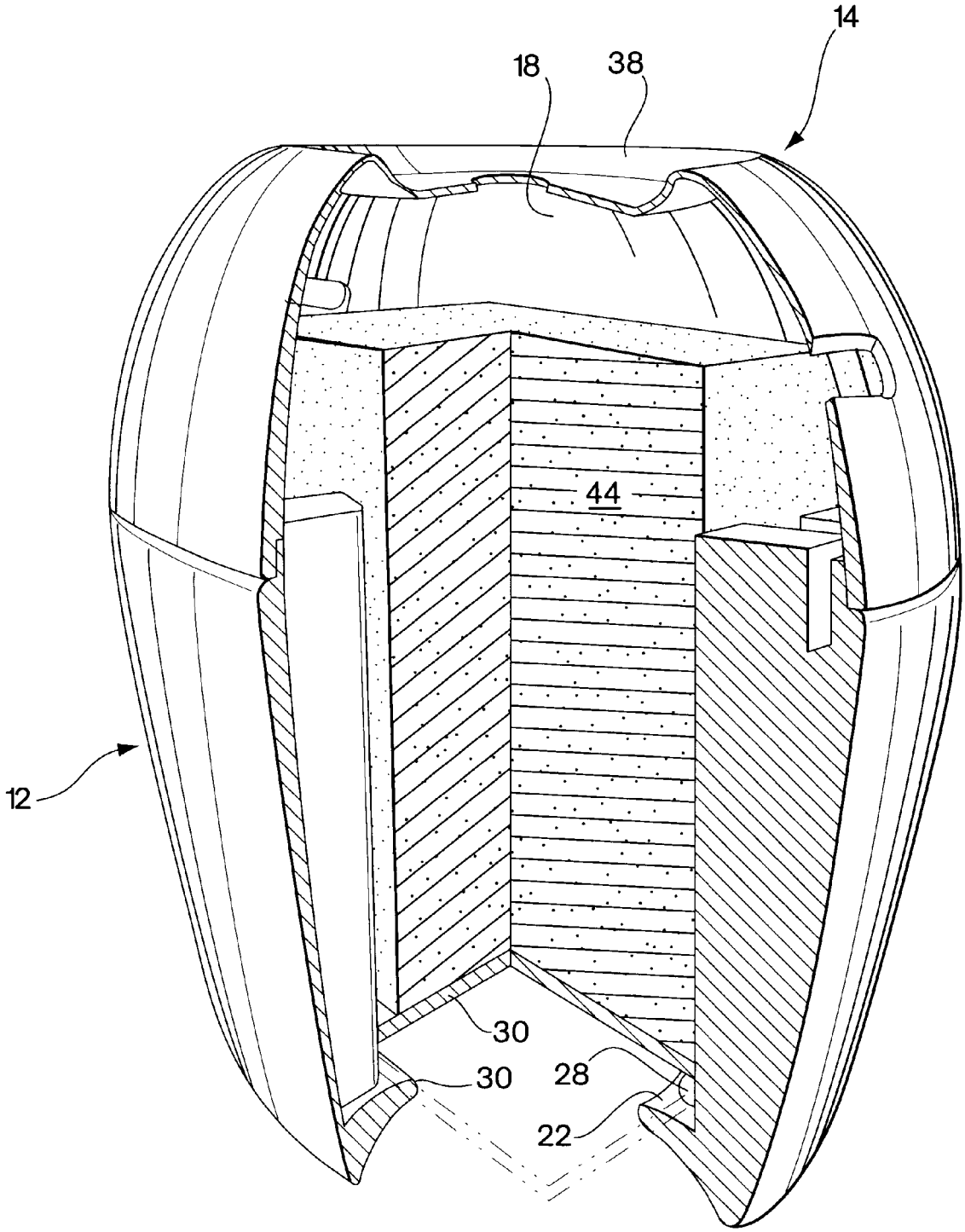
FIG. 4 is the same view as FIG. 3 with a soap bar in the container.

The spacing between the ribs 20 for opposite walls of cavity 16 are slightly greater than the corresponding dimensions of soap bar 44 to be fitted in the container so that when the soap bar is in the container as shown in FIGS. 1 and 4, the soap bar makes contact with the ribs of no more than two sides of the container. Thus, the surface area in contact with the soap bar, and thus the area over which sticking may occur, is minimized. As may also be best seen in FIG. 4, when soap bar 44 is in cavity 16, it rests on plate 30. Thus, to remove the soap bar from the container, all that is required is for the two sections of the container to be separated as shown in FIG. 1. The user then places two fingers through opening 24 against plate 30 and presses upward against the plate. The small area of contact between the soap bar and the walls/ribs of cavity 16 permits the soap bar to be easily dislodged from the cavity with minimum pressure applied to plate 30.

Excess fluid is preferably shaken off the soap bar before it is returned to cavity 16 after use. However, the bar is still wet at this point. When top section 14 is pressed against bottom section 12 to close container 10, a passage for air still exists through the container from opening 26, around plate 30, through ribs 20 and out opening 36, or in the opposite direction from opening 36 to opening 24. This flow of air facilitates rapid drying of the soap bar. To the extent some moisture still flows off the bar, it is accumulated in the container under lips 26 and/or 38 and ultimately dries without flowing from the container. The fit between strap 40 and strap openings 42 is sufficiently tight so as to preclude water flow through these openings. Lips may also be provided around these openings to further impede fluid leakage.

While the invention has been shown above with reference to a preferred embodiment, it is apparent that a number of modifications could be made to this embodiment while still remaining within the invention. For example, instead of a pressure fit between lips 32 and 34, a snap fit or other suitable mating could be provided between the two sections. Further, if the two sections are circular rather than oblong as shown, a short screw fit might be utilized. The configuration for strap 40 is also merely exemplary and, for example, a single strap could be anchored in the lower section and extend through the upper section with a loop at its upper end for holding or hanging. Other configurations for the strap are also within the contemplation of the invention.

Further, while lips for the openings in the sections having been utilized to prevent water flow from the container, these lips could be replaced by other mechanisms for accomplishing this function. For example, instead of an opening 36 in upper section 14, air flow through this section could be achieved through a number of small capillary openings which are too small for water to flow through. Openings in the upper section may also have a bent shape so as to inhibit the flow of water therethrough. Other shapes for the openings in upper section 14 might also be used to inhibit water flow therethrough and/or other techniques utilized for inhibiting such water flow. In addition, while bumps 28 are shown for holding plate 30, studs or other shapes or forms could be utilized for performing this function.

Also, the term "soap bar" or "soap bar product" as used herein is intended to include not only rectangular bars as shown, but bars of various shapes known in the art, as well as related bars such as shampoo bars.

Finally, while ribs 20 have been shown on all sides of cavity 16 to properly position soap bar 44 therein and to prevent the bar from sticking to the walls of the cavity sufficiently so as to make it difficult to dislodge the bar from the cavity, depending on the shape of the soap bar 44 utilized, the number, size, spacing, shape, or other dimensions of the ribs may be different than that shown and, for a soap bar having an oval shape in all dimensions, it is possible that ribs 20 might not be required so long as there is a good air-flow path through the container. Also, while it is preferable that the soap bar contact the ribs for no more than two sides at a time, depending on the size and shape of the soap bar, of cavity 16, and of ribs 20, contact with three, or even all four sides, may be possible without excess sticking occurring.

Thus, while the invention has been shown and described above with reference to a preferred embodiment, the foregoing and other changes and form in detail may be made therein by one skilled in the art without departing from the spirit and scope of the invention which is to be defined only by the following claims.

What is claimed is:

1. A container for a soap bar comprising:

first and second mating sections, said first section having a first hollowed recess formed therein and said second section having a second hollowed recessed formed therein, said first and second recesses being sized to form a soap-bar-receiving chamber when the sections are mated, each of said recesses being open on the side thereof adjacent the other recess when the sections are mated and having a side opposite the open side, a plate positioned in said first recess adjacent said opposite side thereof, an opening large enough for at least one finger of an adult person to fit therein which is formed in said opposite side of the first recess, a support which maintains said plate spaced from said opposite side of the first recess sufficiently to permit air flow to and from said opening around said plate, an opening in said second recess at a position at least near said opposite side thereof, and elements in said first recess which facilitation air flow therethrough and which control the position of the soap bar in said chamber, while limiting contact of the soap bar with the container.

2. A container as claimed in claim 1 wherein said elements includes a plurality of ribs formed in the walls of said first recess.

3. A container as claimed in claim 2 wherein the spacing between ribs formed on opposite walls of said first recess is sufficient so that a soap bar in said first recess can contact the ribs for no more than two such walls at a time.

4. A container as claimed in claim 1 wherein the opening in said second recess is in said opposite side thereof.

5. A container as claimed in claim 1 wherein said support is a plurality of bumps extending from said opposite side of the first recess.

6. A container as claimed in claim 1 including a strap anchored in one of said sections and extending through the other of said sections to hold the sections together when they are not mated.

7. A container as claimed in claim 1 including a lip having a height which is less than that of said support extending around said opening in the first recess to inhibit water exiting the container from said opening.

8. A container as claimed in claim 7 including a lip extending around said opening in the second recess to inhibit water exiting the container from said opening.

9. A container as claimed in claim 1 including means for inhibiting water exiting the container through at least one of said openings.

* * * * *